United States Patent [19]

Mori

[11] 4,100,890

[45] Jul. 18, 1978

[54] MECHANICAL GOVERNOR FOR INTERNAL COMBUSTION ENGINE

[75] Inventor: Koichi Mori, Higashimatsuyama, Japan

[73] Assignee: Diesel Kiki Co., Ltd., Tokyo, Japan

[21] Appl. No.: 695,717

[22] Filed: Jun. 14, 1976

[30] Foreign Application Priority Data

Jun. 13, 1975 [JP] Japan ..... 50-79427[U]

[51] Int. Cl.[2] ..... F02D 1/04; F02D 1/02; F02D 1/00

[52] U.S. Cl. ..... 123/140 R

[58] Field of Search ..... 123/140 R, 140 J

[56] References Cited

U.S. PATENT DOCUMENTS

| | | | |
|---|---|---|---|
| 3,370,579 | 2/1968 | Nozawa et al. | 123/140 R |
| 3,577,968 | 5/1971 | Staudt et al. | 123/140 R |
| 3,672,343 | 6/1972 | Biechl et al. | 123/140 R |
| 3,759,236 | 9/1973 | Straudt et al. | 123/140 J |
| 3,884,206 | 5/1975 | Ritter | 123/140 J |

*Primary Examiner*—Samuel W. Engle
*Assistant Examiner*—Thomas H. Webb
*Attorney, Agent, or Firm*—Sughrue, Rothwell, Mion, Zinn and Macpeak

[57] ABSTRACT

A mechanical governor of a fuel injection pump for internal combustion engines is disclosed wherein a structure, which permits a reduction of the reaction force of a control lever as well as the tension of a balance spring, comprises a first support member fixed to the housing of the mechanical governor, a second support member pivotably mounted on a control lever, and a balance spring, one end thereof being connected to the first support member and the other being connected to the second supporting member.

2 Claims, 4 Drawing Figures

PRIOR ART

FIG. 1 PRIOR ART
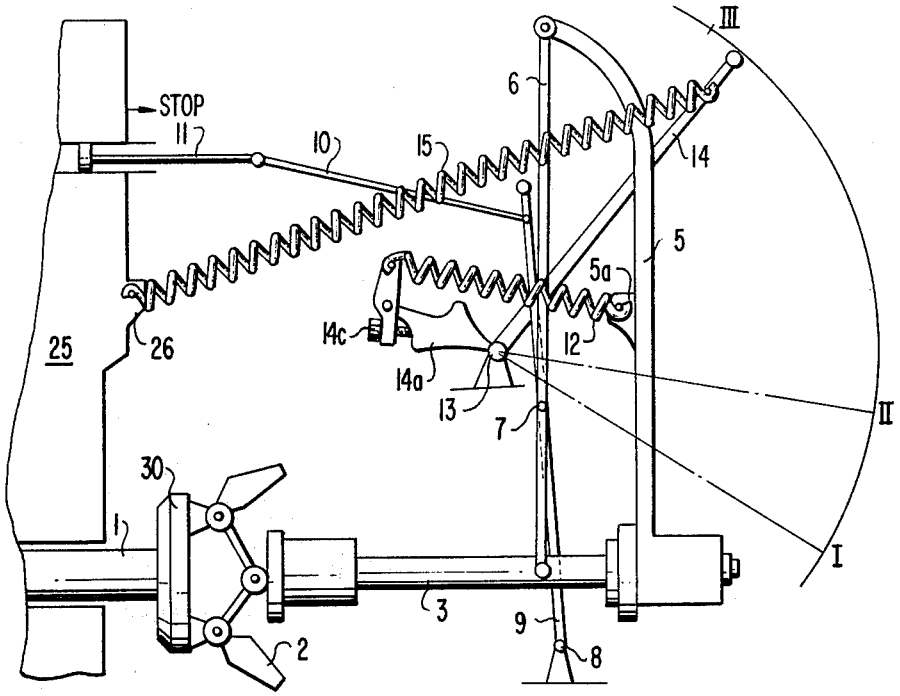
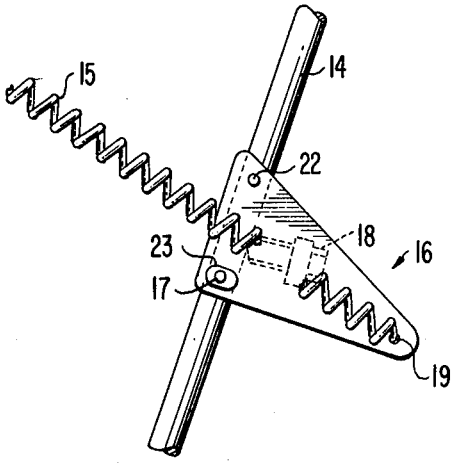
FIG. 3

MECHANICAL GOVERNOR FOR INTERNAL COMBUSTION ENGINE

BACKGROUND OF THE INVENTION

1. Field of the Invention

This invention relates to a mechanical governor for internal combustion engines, and more particulary to a structure for reducing the reaction force of the governor spring at the control lever thereof.

2. Discription of the Prior Art

In a conventional governor for internal combustion engines, there is provided a control lever, which is associated with an accelerating pedal, for controlling the rate of fuel supply. In such a governor, when operating the control lever from an engine start position or an idling position toward the direction of a maximum position, the reaction force exerted on the control lever is gradually increased since the control lever is biased by a governor spring. Therefore, the control lever may be held at a desired rotating speed position of the engine only by continuously applying a force to the accellerator pedal strong enough to balance the reaction force of the governor spring. Conversely, when the control lever is returned to the start position, the tension of the governor spring is reduced, whereby the control lever is liable to become unstable in the vicinity of the idling position.

Recently, it has been proposed to provide a mechanical governor with a balance spring which is used as a means of reducing the force required to operate the control lever. The blance spring is arranged so that it opposes the force of the governor spring, thereby reducing the required pedal force needed to maintain the control lever at a fixed position. However, if one attempts to adjust the speed regulation of the governor, expressed by $N_2 - N_1/N_1$, wherein $N_2$ is maximum r.p.m. at termination of regulation and $N_1$ is the r.p.m. of the engine at the start of regulation, the reaction force on the control lever will be altered. This occurs because adjustment is carried out by varying the tension force of the governor spring. If the speed droop of the governor is changed or adjusted to a desired value, it is necessary to adjust not only the governor spring but also the balance spring. However, there is no provision for any adjusting means. That is, when the tension of the governor spring is adjusted, the tension of the balance spring simultaneously changes since the balance point of the control lever varies by the adjustment of the governor spring.

SUMMARY OF THE INVENTION

It is, therefore, a main object of the present invention to provide an improved mechanical governor.

Another object of the present invention is to provide an improved mechanical governor in which it is possible to easily carry out the speed droop of the governor.

These and other objects, features and advantages of the invention will become more apparent upon a reading of the following detailed specification and drawings.

BRIEF DESCRIPTION OF THE DRAWINGS

FIG. 1 is a diagrammatic view of a conventional mechanical governor for internal combustion engines.

FIG. 3 is an enlarged rear elevation view of a variable tension device of the present invention.

DETAILED DESCRIPTION OF THE INVENTION

Figure 2:
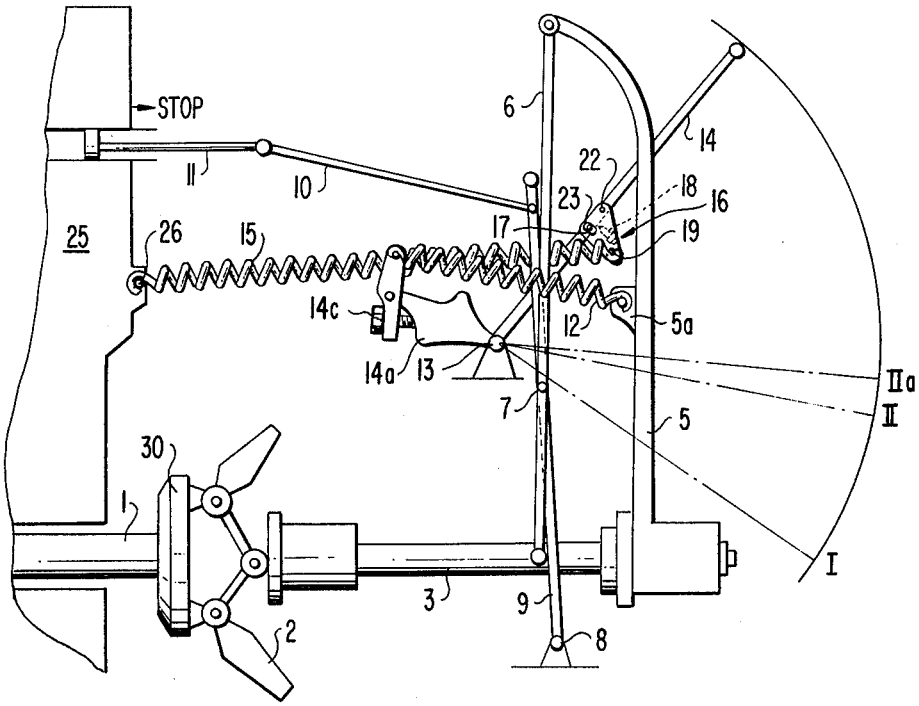
FIG. 2 is a diagrammatic view of an embodiment of the present invention.

Referring to the conventional governor mechanism of FIG. 1, a cam shaft 1 of a fuel injection pump (not shown) has a carrier member 30, on which centrifugal weights 2 are pivotably mounted in a known manner. A shifting means or rod 3 moves to the right in response to increasing rotation of the centrifugal weights. The movement of the shifter 3 is transmitted to a guide lever 6, and then, to a control rod 11 through a link 10 connected to an upper portion of a floating lever 9. The rod 11 controls the fuel supply quantity.

On this device, a governor spring 12 is provided between a control arm 14*a* of a control lever 14 and an intermediate projection 5*a* of the tension lever 5. A balance spring 15 is also mounted between the control lever 14 and a spring mounting portion 26 on a housing 25.

The lever 14 is connected to the accelerator pedal in a conventional manner to cause the lever to move counterclockwise as the pedal is depressed. The movement of lever 14 toward position III is transferred via governor spring 12, tension lever 5, guide lever 6, and floating lever 9, to the control rod 11 to move the control rod 11 to the left thereby increasing the fuel supply quantity. The increased rotation of the engine tends to push rod 3 to the right thereby moving the tension lever 5 to the right and increasing the tension of governor spring 12. This tends to provide a strong reaction force on the control lever 14, with all its attendent disadvantages. The balancing spring, however, acts oppositely on the control lever, as is apparent from the drawing, to reduce the combined reaction force (the force acting against that force applied to the accelerator) on the control lever.

Figure 4:
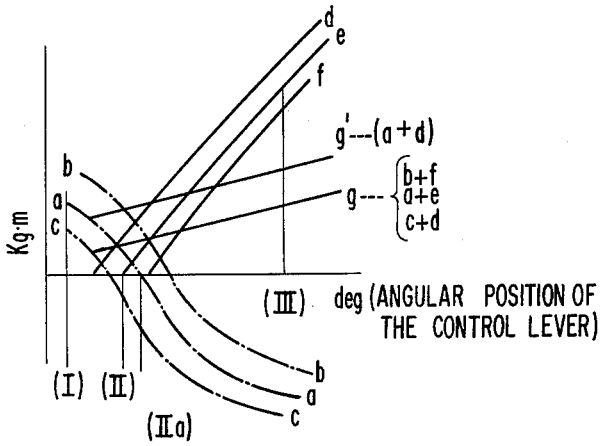
FIG. 4 is a curve illustrating the relationship between the reaction force of the lever and the lever rotating angle.

Referring to FIG. 4, there is shown a graph of force (plotted on the ordinate axis) versus angular position of the control lever (plotted on the abscissa axis). In order to understand the prior art it is assumed that curve *a* represents the force the balancing spring 15, curve *e* represents the force of the governor spring, and curve *g* is the reaction force, i.e. the combination of curves *a* and *e*. All forces below the horizontal axis tend to rotate lever 14 in the counterclockwise direction and vice versus.

As will be appreciated, an adjustment of the tension of the governor spring 12 results in a shifting from curve *e* to either *d* or *f*. This, in turn, results in the combined reaction force shifting, e.g. from curve *g* to curve *g'*.

According to the present invention, adjustment of the speed droop can be obtained without incurring any substantial variation in the reaction curve *g*.

FIGS. 2 and 3 show an embodiment of the present invention, wherein 14 designates a control lever which is provided so as to rotate about a pin 13 on the housing 25. A governor spring 12 is provided between a control arm 14*a* of the control lever 14 and an intermediate projection 5*a* of the tension lever 5 in the known manner. Further, a balance spring is also mounted between a supporting member 16 of the control lever 14 and a supporting member 26 on the housing 25. The support member 16 is mounted so as to pivotably move about a pin 22 fixed to the control lever, and has an elongated hole 23 loosely engaged with a pin 17 on the control lever 14, a screw 18 for adjusting the bias force of the balance spring 15, and a pin 19 for mounting one end of the balance spring 15. The other end of spring 15 is fixedly mounted on the support member 26 on the housing 25. The effect of this construction is as follows. When screw 14*c* is twisted to settle a little speed droop, the reaction force curve of the control lever is altered from curve *e* to *d*. Therefore the screw 18 of the supporting member is twisted in a counterclockwise direction so as to alter the force curve from *a* to *c* to correspond to the change from *e* to *d*. Consequently, the combined reaction force changes very slightly. Moreover the balance spring is mounted in such a manner that the straight line connecting the pin 19 of the support member and pin 26 on the housing passes through the axis of pivot 13 when the control lever is in a little higher position than the idling position as shown in II*a*. As the support member 16 is so constructed as to move about the pivot 22, the dead point of the balance spring 15 can be changed by rotating the screw 18, whereby to cause any cancelling force with respect to the governor spring. Thus, the force of the balancing spring can be altered from curve *a* (FIG. 4) to curves *b* or *c*, to compensate for changes in the force of the governor spring, thereby maintaining the combined reaction force curve despite adjustment of the speed droop.

Also, the position II*a* (FIG. 2) of control lever 14, which corresponds to the dead point of balancing spring 15 (i.e. the point at which the spring passes through the axis of pin 13) is only slightly above the start on idling position II. This tends to avoid the problem of instability of the control lever at the idling position.

What is claimed is:

1. In a mechanical governor apparatus of a fuel injection pump for an internal combustion engine of the type having, a control lever the position of which is determined by the force on an accelerator pedal, a fuel determining control rod moveable by said control lever, a governor and a governor spring for exerting a force on said control lever opposite to that exerted on said pedal, and a balance spring connected between a housing and said control lever to oppose the force applied to said control lever by said accelerator and a means on said control lever for balancing the force of said governor spring, the improvement comprising, a first support member fixed to said housing, a second support member pivotally mounted on said control lever and adjustable with respect to said lever, one end of said balance spring being connected to said first support member and the other being connected to said second supporting member.

2. The structure of claim 1, wherein said second support member comprises a screw for adjusting the tension of the balance spring, a pin for mounting the balance spring, and an elongated hole for loosely engaging with the control lever, said first and second support members and said balance spring being mounted in such a manner that a straight line connecting said support members intersects the pivoting axis of said control lever when said control lever is in a little higher position than the idling position.

* * * * *